US006402586B1

(12) United States Patent
Winik et al.

(10) Patent No.: US 6,402,586 B1
(45) Date of Patent: Jun. 11, 2002

(54) POST-SURGICAL BRA

(76) Inventors: Claire Winik, 1841 Lawnview Dr., Frederick, MD (US) 21701; Heather B. Kepler; Krista B. White, both of 359 Sir Chandler Dr., Kill Devils Hills, NC (US) 27948

( * ) Notice: Subject to any disclaimer, the term of this patent is extended or adjusted under 35 U.S.C. 154(b) by 0 days.

(21) Appl. No.: 09/862,515

(22) Filed: May 23, 2001

(51) Int. Cl.[7] ..... A41C 3/00
(52) U.S. Cl. ..... 450/78; 450/1
(58) Field of Search ..... 450/1, 78, 2, 79, 450/80, 82, 58, 64, 65, 66, 67, 69, 70, 71, 72, 34, 84; 2/67, 69, 105, 106, 115, 113; 602/1, 20, 60, 61

(56) References Cited

U.S. PATENT DOCUMENTS

| | | | |
|---|---|---|---|
| 2,132,128 | A | 10/1938 | Rasch |
| 2,676,321 | A | 4/1954 | Dubner |
| 3,847,158 | A | 11/1974 | Guidoni |
| 3,939,845 | A | 2/1976 | Guidoni |
| 4,411,269 | A | 10/1983 | Weintraub |
| 4,995,847 | A | 2/1991 | Hwang |
| 5,334,082 | A | 8/1994 | Barker |
| D355,294 | S | 2/1995 | Bussey et al. |
| 5,782,672 | A | 7/1998 | Woodley |
| 5,820,444 | A | 10/1998 | McGaughey |
| 6,074,272 | A | 6/2000 | Hebert |

*Primary Examiner*—Gloria M. Hale
(74) *Attorney, Agent, or Firm*—Richard C. Litman

(57) ABSTRACT

A post-surgical bra to be worn by women whose breasts have been surgically augmented. The brassiere is fabricated from soft cotton, spandex (LYCRA™) or polyester blends. Each cup is reinforced at the center and an insert is provided to ensure a smooth, opaque appearance. The brassiere is devoid of any breast supporting structure such as elastic panels and/or underwire. Adjustable, cloth straps are provided to support the brassiere from the wearer's shoulders. An elastic band passes through a hem at the bottom of each cup and through openings in the shoulder straps. The cups are dimensioned to be wider than comparable cups in conventional brassieres to accommodate the generally increased width of augmented breasts.

12 Claims, 2 Drawing Sheets

POST-SURGICAL BRA

BACKGROUND OF THE INVENTION

1. Field of the Invention

The present invention generally relates to women's lingerie. More specifically, the present invention is drawn to a brassiere for augmented breasts.

2. Description of the Related Art

The past decade has witnessed a phenomenal growth in the field of cosmetic surgery. Once the province of movie stars and other public celebrities, face lifts, tummy tucks, liposuction, etc. have been adopted by the masses with such fervor that cosmetic surgery has become a multi-million dollar industry. Aside from the face lift, augmentation of the female breast is probably the most common cosmetic surgery performed.

After breast augmentation, problems have arisen involving the selection and wearing of a proper and comfortable brassiere. First, the augmented breast is substantially self supporting and does not require the uncomfortable support structure (underwire, hard elastic, etc.) incorporated in most conventional brassieres; secondly, after surgery, the breasts tend to be wider, consequently they are not completely covered by the cup sizes of conventional brassieres; third, protrusion of the nipples of augmented breasts often can be detected through an outer garment creating an unflattering image.

Examples of prior art brassieres which employ support structure are disclosed in U.S. Pat. No. Des. 355,294 (Bussey et al.), U.S. Pat. No. 2,132,128 (Rasch), U.S. Pat. No. 2,676,321 (Dubner), U.S. Pat. No. 4,411,269 (Weintraub) and U.S. Pat. No. 5,820,444 (McGuaghey).

U.S. Pat. No. 3,847,158 and 3,939,845, both to Guidoni, show brassieres used for bathing suits. Neither patent is concerned about masking nipple protrusion.

U.S. Pat. No. 4,995,847 (Hwang) is drawn to adjuster structure for a brassiere. There is no discussion as to the structural makeup of the brassiere per se.

U.S. Pat. No. 5,334,082 (Barker) discloses a brassiere having pouches to retain a breast-augmenting gel pack.

U.S. Pat. No. 5,782,672 (Woodley) discloses nipple covers to be worn by women who choose not to wear brassieres.

U.S. Pat. No. 6,074,272 (Herbert) shows a liner to be used by nursing mothers to avert leaking fluid from soiling the mother's clothing.

None of the above inventions and patents, taken either singularly or in combination, is seen to disclose a brassiere especially designed to be worn after breast augmentation surgery as will subsequently be described and claimed in the instant invention.

SUMMARY OF THE INVENTION

The instant invention,to be dubbed "Sweet Bra", is a brassiere to be worn by women whose breasts have been surgically augmented. The brassiere is fabricated from soft cotton, LYCRA, or polyester blends. Each cup is reinforced at the center and an insert is provided to ensure a smooth, opaque appearance. The brassiere is devoid of any breast supporting structure such as elastic panels and/or underwire. Adjustable, cloth straps are provided to support the brassiere from the wearer's shoulders. An elastic band passes through a hem at the bottom of each cup and through loops in the shoulder straps. The cups are dimensioned to be wider than comparable cups in conventional brassieres to accommodate the generally increased width of augmented breasts. The brassiere of the instant invention may be utilized as a swim top or a maternity bra, if desired.

Accordingly, it is a principal object of the invention to provide a brassiere, which brassiere is adapted to be used by women who have had breast augmentation surgery.

It is another object of the invention to provide a brassiere which is comfortable to wear.

It is a further object of the invention to provide a brassiere which is devoid of any extraneous breast supporting structure.

Still another object of the invention is to provide a brassiere having an insert which will present a smooth and opaque appearance when the brassiere is worn.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
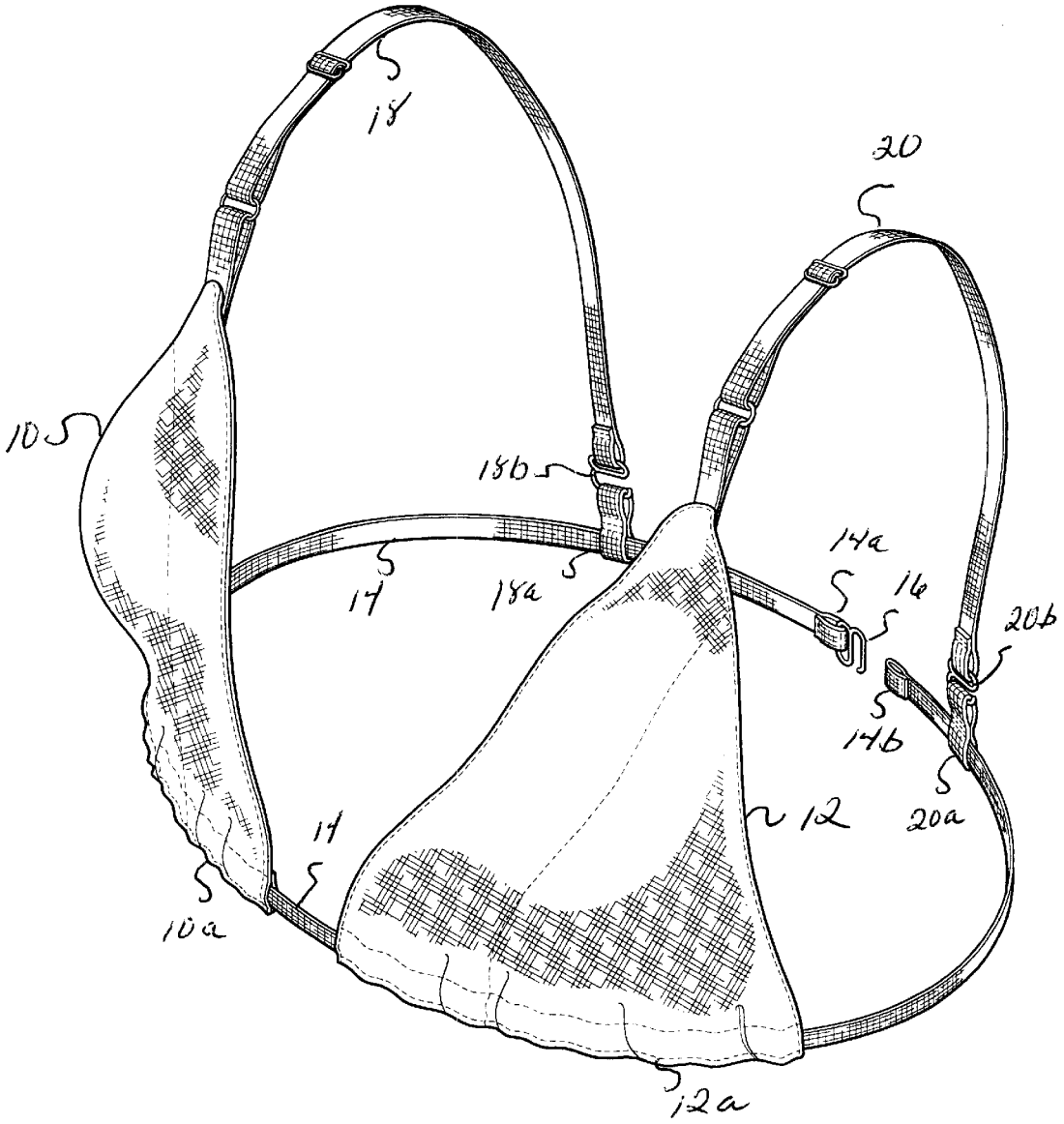
FIG. 1 is a perspective view of a post surgical brassiere according to the present invention.
Figure 2:
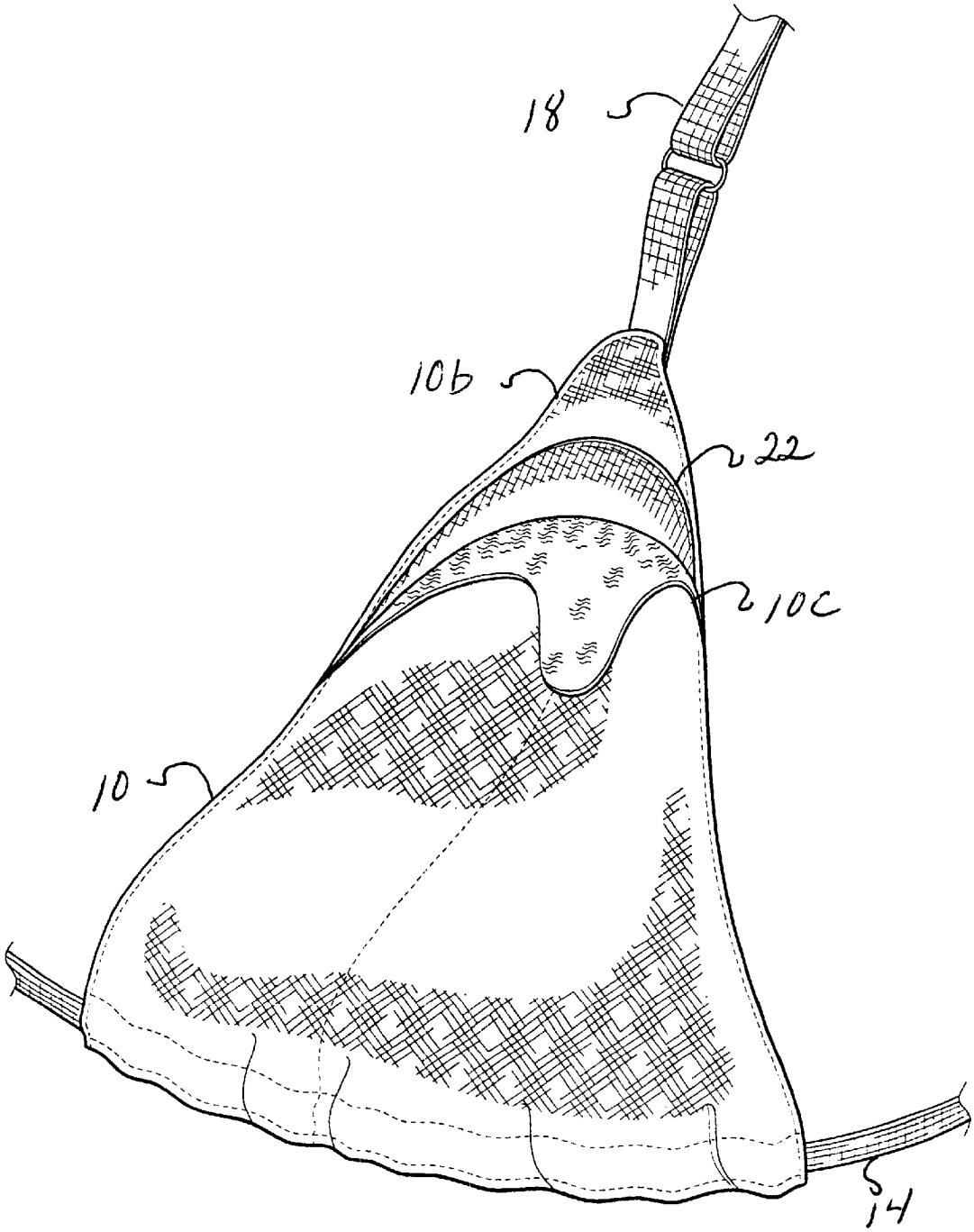
FIG. 2 is a partial, cut-away view of a post surgical brassiere according to the present invention.

The present invention, as illustrated in FIGS. 1 and 2, comprises cup members 10 and 12 having respective hems 10*a* and 12*a* disposed at each bottom portion thereof. An elastic band 14 extends through the hems and terminates in ends 14*a*, 14*b*. Ends 14*a*, 14*b* may be joined together with any suitable conventional fastening device 16. Although illustrated as a rear closure, it is obvious that the brassiere could employ a front closure if desired. A shoulder strap 18 is attached at one end to the upper portion of cup 10. At its other end, strap 18 is slidingly attached to elastic band 14 by means of a loop 18*a* and a conventional S-hook 18*b*. Shoulder strap 20 is attached to cup 12 and band 14 via loop 20*a* and S-hook 20*b* in an identical manner.

As best seen in FIG. 2, cup member 10 is constructed of inner 10*b* and outer 10*c* layers of soft, pliable material such as cotton, LYCRA or polyester blends. An insert 22 is positioned between layers 10*b*, 10*c* before the layers are stitched or otherwise joined together. Insert 22 is fabricated from a soft thin fabric the same as, or similar to, the fabric of layers 10*b*, 10*c*. As mentioned above, the insert will ensure a smooth, opaque appearance for the wearer. A central area over the center of the cup may be reinforced if necessary. Cup member 12 will be constructed in the same manner.

Because augmented breasts tend to be rounder, a wider cup is necessary for proper coverage. In each of the standard cup sizes, A, B, C and D, the width of the cup of the instant invention exceeds that of conventional cup sizes. For example, in the size 34 "MAIDEN FORM" brassiere, the width of cup A is six inches; cup B-seven inches; cup C-eight inches; cup D-nine inches. The width of the cups of the instant invention for size 34 are cup A-seven and one-half inches; cup B-eight inches; cup C-nine inches; cup D-ten inches. The wider cup of the invention is prevalent in all brassiere sizes (32, 34, 36, 38) and exceeds the widths of all known brands.

It is to be understood that the present invention is not limited to the embodiment described above, but encompasses any and all embodiments within the scope of the following claims.

We claim:

1. A post-surgical brassiere comprising:

a pair of breast cups, each cup of said pair having an upper portion, a lower portion, a front panel, a rear panel and a width;

a hem, said hem defining the lower portion of each said pair of breast cups;

an elastic band, said elastic band having a first end and a second end and disposed through said hem;

a pair of support straps, each support strap of said pair having an upper end and a lower end, said upper end of each strap being attached to said upper portion of a respective breast cup;

means for attaching each said lower end of each said support strap to said elastic band for sliding movement thereon.

2. The post-surgical brassiere as recited in claim 1, wherein said means for attaching includes a loop and an S-hook.

3. The post-surgical brassiere as recited in claim 2, further comprising:

a pair of inserts, each insert of said pair positioned and secured between said front panel and said rear panel of each cup of said pair.

4. The post surgical-brassiere as recited in claim 3, further comprising:

means for fastening said first end of said elastic band to said second end of said elastic band.

5. The post-surgical brassiere as recited in claim 4, wherein said front panel and said rear panel are fabricated from a soft pliable material.

6. The post-surgical brassiere as recited in claim 5, wherein said insert is fabricated from a soft pliable material.

7. The post-surgical brassiere as recited in claim 6, wherein said width of each cup of said pair is at least one-half inch wider than a width of a conventional brassiere cup.

8. A post-surgical brassiere comprising:

a pair of breast cups, each cup of said pair having an upper portion, a lower portion, a front panel, a rear panel and a width;

a hem, said hem defining the lower portion of each said pair of breast cups;

an elastic band, said elastic band having a first end and a second end and disposed through said hem;

means for fastening said first end to said second end;

a pair of support straps, each support strap of said pair having an upper end and a lower end, said upper end of each strap being attached to said upper portion of a respective breast cup;

an loop defining each said lower end of each said support strap; and said elastic band being disposed through each loop for sliding movement therein.

9. The post-surgical brassiere as recited in claim 8, further comprising:

a pair of inserts, each insert of said pair positioned and secured between said front panel and said rear panel of each cup of said pair.

10. The post-surgical brassiere as recited in claim 9, wherein said front panel and said rear panel are fabricated from a soft pliable material.

11. The post-surgical brassiere as recited in claim 10, wherein said insert is fabricated from a soft pliable material.

12. The post-surgical brassiere as recited in claim 11, wherein said width of each cup of said pair is at least one-half inch wider than a width of a conventional brassiere cup.

* * * * *